US005826391A

United States Patent [19]

Underwood

[11] Patent Number: 5,826,391

[45] Date of Patent: Oct. 27, 1998

[54] CONCRETE JOINT AND METHOD

[76] Inventor: Daniel Charles Underwood, Factory Shed 3, Unit 1, 197 Murarrie Road, Murarrie, Queensland 4172, Australia

[21] Appl. No.: 749,650

[22] Filed: Nov. 15, 1996

[30] Foreign Application Priority Data

Nov. 15, 1995 [AU] Australia ..... PN6584

[51] Int. Cl.[6] ..... E01C 11/02

[52] U.S. Cl. ..... 52/414; 52/396.02; 52/699; 52/700; 249/3; 249/9; 249/98; 404/48; 404/50; 404/51; 411/469; 411/493; 411/497

[58] Field of Search ..... 52/414, 699, 700, 52/396.02; 249/3, 9, 98; 404/47, 48, 49, 50, 51, 52, 60, 61, 62, 63; 411/445, 469, 497, 475, 480, 481, 490, 493, 495, 487

[56] References Cited

U.S. PATENT DOCUMENTS

| | | | |
|---|---|---|---|
| 729,336 | 5/1903 | Hass | 411/493 |
| 860,479 | 7/1907 | Ingersoll | 249/16 |
| 937,157 | 10/1909 | Laible | 411/480 X |
| 1,255,611 | 2/1918 | Innes | 249/9 X |
| 1,538,619 | 5/1925 | Burrell | 404/50 |
| 1,546,005 | 7/1925 | Briody | 404/51 |
| 1,570,970 | 1/1926 | Milar | 404/51 |
| 1,711,934 | 5/1929 | Fischer | 404/50 |
| 1,741,585 | 12/1929 | Robertson | 404/51 |
| 1,988,269 | 1/1935 | Fink | 404/47 |
| 2,027,725 | 1/1936 | Fischer | 404/50 |
| 3,437,018 | 4/1969 | Jackson | 404/50 |
| 3,497,172 | 2/1970 | Welch | 249/3 |
| 3,628,764 | 12/1971 | Burton | 404/50 X |
| 5,092,091 | 3/1992 | Hull et al. | 52/396.02 |

*Primary Examiner*—Carl D. Friedman
*Assistant Examiner*—Laura A. Callo
*Attorney, Agent, or Firm*—Young & Thompson

[57] ABSTRACT

A formwork comprising a metal panel 11 having an upper portion 12, a lower portion 13 and a intermediate portion 14 displaced laterally out of the line of the panel 11, the portions 12 and 13 have spaced holes 15 through which reinforcing rods 16 project so that the ends of the reinforcing rods can be tied to similar rods in an adjacent slab to be poured in order to occupy the space at 17. A slab poured upon a timber deck 18 and the metal form provided by the panel 11 is retained in place by upright bracing rods 19 located at spaced intervals along the form 11 and passing through pairs of holes 20 and 21 in the intermediate section 14.

5 Claims, 1 Drawing Sheet

CONCRETE JOINT AND METHOD

FIELD OF THE INVENTION

THIS INVENTION relates to a concrete joint and method for setting formwork for joining separately poured concrete flooring slabs where labour content is reduced compared to prior art methods.

BACKGROUND ART

Application of concrete to form a reinforced floor or the like covering a relatively large area usually involves laying separate adjoining slabs at different times. Timber formwork is commonly employed and stripped away before the adjoining slab is poured. One formwork employs three horizontal planks spaced vertically so that steel reinforcing bars can project between the planks. The projecting bars are tied into to the steel of the adjoining slab. The planks are usually braced by suitable timber bracing or any other suitable bracing.

This is typical of methods used and particularly where the under surface is a timber deck the bracing can be nailed to the deck but nether-the-less placement of the planks, construction of the bracing and later stripping of all those components prior to the next slab being poured is time consuming the labour intensive.

It is an object of the present invention to provide an alternative where less labour is required and involves permanent implantation of the formwork in the slab and a simple and effective removable bracing therefore.

OUTLINE OF THE INVENTION

In one aspect therefore the present invention resides in an edge formwork for a part of a slab poured on a deck prior to an adjoining part of the slab being poured, the formwork comprising a narrow elongate sheet metal panel having an upper portion, a lower portion and an intermediate portion displaced laterally out of the longitudinal line of the panel, the respective upper and lower portions having holes at spaced intervals along the panel, the upper and lower portions having reinforcing rods projecting through the holes therein and into a space to be occupied by a marginal edge portion of the adjoining slab, and the intermediate section having pairs of spaced aligned holes set at intervals along the panel and offset relative to the reinforcing rods, selected ones of said pairs of holes having respective upright bracing members extending through the intermediate section, each bracing member comprising a removable rod including a lower end engaging the deck and having means enabling the lower end to be secured to the deck. In one preferred embodiment the rod includes a nail point driven into the deck. The rod is preferably solid and the nail point is preferably a concrete pin held by epoxy resin in a hole drilled into the rod, the pin being held to project from the end of the rod.

The metal panel is permanently retained in the slab after the upright bracing rods are removed and the adjoining slab poured. Preferably the metal panel includes surface protrusions or indentations on one or both sides of the panel to enhance the adhesion between the slab and the panel.

The intermediate portion can be displaced along the entire length of the panel or separate periodically displaced sections of the panel can be provided for the purpose of accommodating the upright members.

The holes in the intermediate portion receiving the upright members are approximately the same dimension as the rods so that there is a tight fit although loose fitting is also suitable. Typically the upright members have to be driven through the holes and into the surface below thereby providing maximum stability.

The uprights can be arranged so that they are additionally supported at there upper ends by tensioning cables or the like if desired but this is not usual. The upper ends of the uprights preferably include a transverse member or a head to enable the uprights to be driven using a hammer and to facilitate manual manipulation of the uprights. The uprights are typically T-shaped.

BRIEF DESCRIPTION OF THE DRAWINGS

In order that the present invention can be more readily understood and be put into practical effect reference will now be made to the accompanying drawings and wherein.

Figures 1, 2:
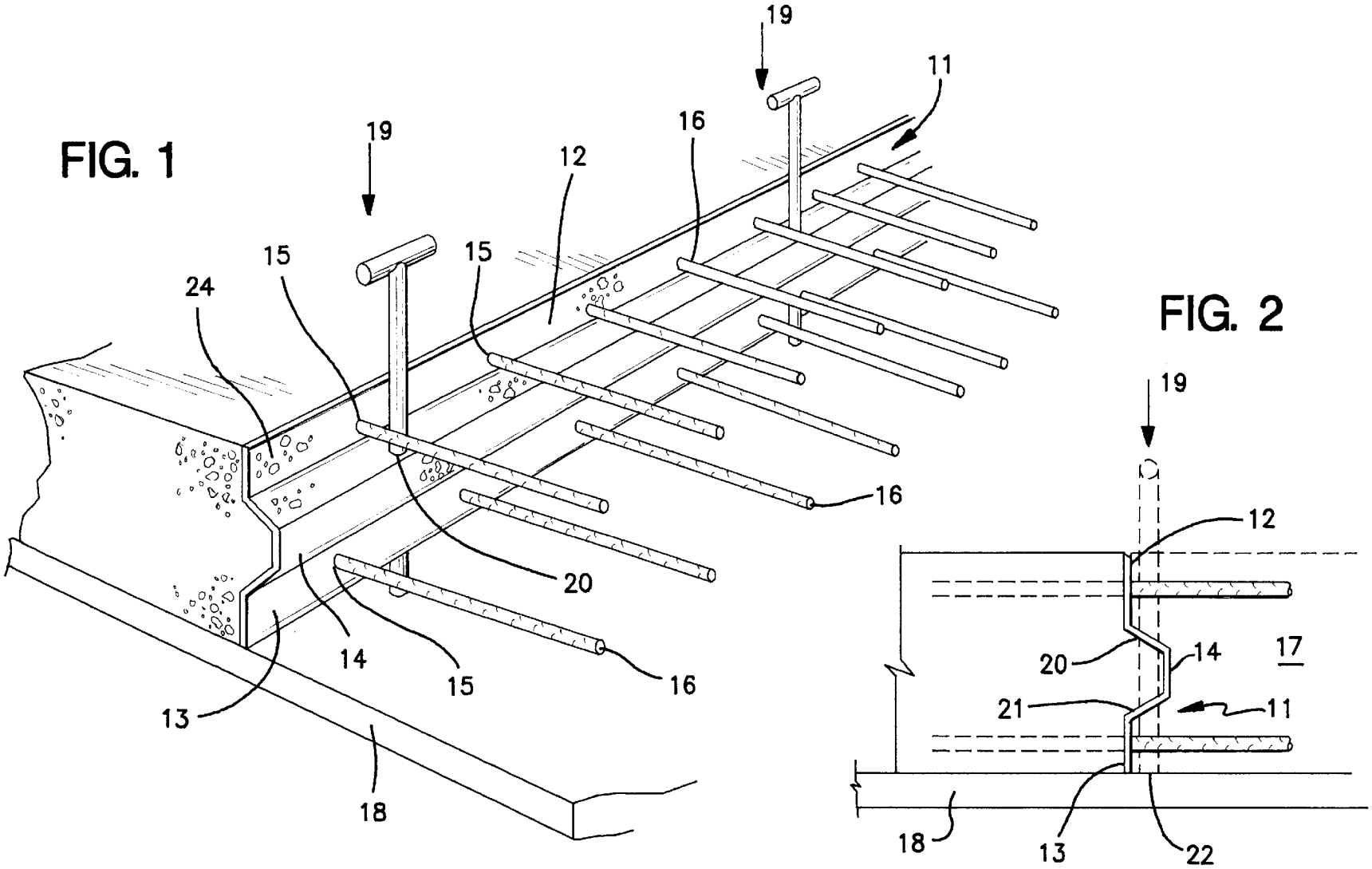
FIG. 1 is a respective view illustrating one embodiment of the present invention.
FIG. 2 is a transverse section through FIG. 1.

Referring the drawings there is illustrated an edge portion of a concrete slab supported by a formwork comprising a metal panel 11 having an upper portion 12, a lower portion 13 and a intermediate portion 14 displaced laterally out of the line of the panel 11, the portions 12 and 13 have spaced holes 15 through which reinforcing rods 16 project so that the ends of the reinforcing rods can be tied to similar rods in an adjacent slab to be poured in order to occupy the space at 17. In the illustrated embodiment the slab is being poured upon a timber deck 18 and the metal form provided by the panel 11 is retained in place by upright bracing rods 19 located at spaced intervals along the form 11 and passing through pairs of holes 20 and 21 in the intermediate section 14.

As can be seen in FIG. 2 the upright 19 shown in phantom includes a nail point 22 in its lower end, the nail point being driven into the timber deck 18. As a consequence of the rod 19 being supported as a tight fit in the holes 20 and 21 the deck being engaged by the rods at spaced intervals along its length and rods 19 being provided at spaced intervals along the panel 11 the form is effectively self supporting and rigid along its length.

Each of the rods 19 include transverse members so that the rods 19 are generally T-shaped made from approximately half inch to three-quarter inch rigid metal rod so that the rods can be driven using a hammer through the holes 20 and 21 and down into the deck 18.

The panel 11 has a dimpled surface shown in part at 24 and this assists adhesion between the slab and the panel 11 to inhibit shear.

Whilst the above has been given by way of illustrative example of the present invention, many variations and modifications thereto will be apparent to those skilled in the art without departing from the broad ambit and scope of the invention as herein set forth.

I claim:

1. In combination with a wooden deck and a slab poured on the deck, an edge formwork for a part of the slab poured on the deck prior to an adjoining part of the slab being poured, the formwork comprising a narrow elongate sheet metal panel having an upper portion, a lower portion and an intermediate portion displaced laterally out of the longitudinal line of the panel, the respective upper and lower portions having holes at spaced intervals along the panel, the upper and lower portions having reinforcing rods projecting through the holes therein and into a space to be occupied by a marginal edge portion of the adjoining slab, and the intermediate section having pairs of spaced aligned holes set at intervals along the panel and offset relative to the reinforcing rods, selected ones of said pairs of holes having respective upright bracing members extending through the intermediate section, each upright bracing member comprising a removable rod including an upper end projecting above the panel and a lower end engaging the deck and having a nail point driven into the wooden deck, the upright bracing member being solid and the nail point comprising a pin held by adhesive in a hole drilled into the upright bracing member, the pin being held to project from the end of the upright bracing member.

2. The combination according to claim 1 wherein the metal panel includes surface protrusions or indentations on one or both sides of the panel to enhance the adhesion between the slab and the panel.

3. The combination according to claim 1 wherein the intermediate portion is displaced along the entire length of the panel or is separate periodically displaced sections of the panel provided for the purpose of providing the holes accommodating the upright bracing members.

4. The combination according to claim 1 wherein the holes in the intermediate portion receiving the upright bracing members are approximately the same dimension as the upright bracing members so that there is a tight fit and the upright bracing members have to be driven through the holes and into the surface below thereby providing maximum stability.

5. The combination according to claim 1 wherein the upper ends of the upright bracing members include a transverse member or a head to enable the upright bracing members to be driven using a hammer and to facilitate manual manipulation of the upright bracing members for their removal from the deck.

* * * * *